US011273337B2

(12) United States Patent
George

(10) Patent No.: US 11,273,337 B2
(45) Date of Patent: Mar. 15, 2022

(54) DUAL AND SOLO EXERCISE APPARATUS

(71) Applicant: Victor George, Brooklyn, NY (US)

(72) Inventor: Victor George, Brooklyn, NY (US)

( * ) Notice: Subject to any disclaimer, the term of this patent is extended or adjusted under 35 U.S.C. 154(b) by 99 days.

(21) Appl. No.: 16/738,500

(22) Filed: Jan. 9, 2020

(65) Prior Publication Data

US 2020/0222739 A1 Jul. 16, 2020

Related U.S. Application Data

(60) Provisional application No. 62/830,640, filed on Apr. 8, 2019, provisional application No. 62/790,654, filed on Jan. 10, 2019.

(51) Int. Cl.

| | |
|---|---|
| ***A63B 21/00*** | (2006.01) |
| ***A63B 1/00*** | (2006.01) |
| ***A63B 23/12*** | (2006.01) |

(52) U.S. Cl.

CPC ..... *A63B 21/00047* (2013.01); *A63B 1/00* (2013.01); *A63B 23/1227* (2013.01); *A63B 23/1236* (2013.01); *A63B 2210/50* (2013.01); *A63B 2225/09* (2013.01)

(58) Field of Classification Search

CPC ..... A63B 21/00047; A63B 21/0023; A63B 2225/09; A63B 2210/50; A63B 21/4035; A63B 23/0216; A63B 23/1218; A63B 23/1227; A63B 23/1236; A63B 21/068; A63B 1/00; A63B 2071/025; A63B 2225/107; A63B 3/00; A63B 9/00; A63B 2009/006; A63B 17/00–04; A63B 2023/006; A63B 23/12–1236

See application file for complete search history.

(56) References Cited

U.S. PATENT DOCUMENTS

| | | | | |
|---|---|---|---|---|
| 3,948,513 | A * | 4/1976 | Pfotenhauer | A63B 17/04 482/142 |
| 8,834,327 | B1 * | 9/2014 | George, Jr. | A63B 21/4029 482/96 |
| 9,492,701 | B1 * | 11/2016 | Bognatz | A63B 21/072 |
| 10,143,298 | B2 * | 12/2018 | Wood | A47B 47/0091 |
| 10,471,293 | B2 * | 11/2019 | George | A63B 23/0405 |
| 10,525,300 | B1 * | 1/2020 | Boatwright | A63B 23/1218 |
| 10,576,322 | B2 * | 3/2020 | Schlegel | A63B 69/34 |

(Continued)

*Primary Examiner* — Megan Anderson
*Assistant Examiner* — Kathleen M Fisk
(74) *Attorney, Agent, or Firm* — Abelman, Frayne & Schwab

(57) ABSTRACT

A modular exercise apparatus includes a pair of vertical frame members secured in spaced-apart relation by two or more internally threaded cross bars the ends of which are fitted with L-shaped mounting brackets that are manually secured by threaded mounting bolts passing through opposing aligned apertures in the frame members and into the threaded ends of the cross bars, the frame members further stabilized by at least one flanged U-shaped supporting member secured to a base member of the frame members by a threaded mounting bolt, enabling the apparatus to be assembled without the use of tools to form a variable, stable configuration that allows one or two users to execute a wide variety of vigorous exercises, and disassembled for compact storage. For solo use, the frame members are reduced in length and weight facilitating ease of movement of the assembled unit, as well as the disposition for storage.

15 Claims, 6 Drawing Sheets

(56) References Cited

U.S. PATENT DOCUMENTS

| | | | | |
|---|---|---|---|---|
| 11,007,392 | B2 * | 5/2021 | Schlegel | A63B 71/023 |
| 2007/0032357 | A1 * | 2/2007 | Piane | A63B 71/0036 482/142 |
| 2009/0069161 | A1 * | 3/2009 | Caldwell | A63B 23/12 482/138 |
| 2014/0243174 | A1 * | 8/2014 | Alenaddaf | A63B 17/00 482/142 |
| 2020/0384337 | A1 * | 12/2020 | Brasch | A63B 21/078 |

* cited by examiner

DUAL AND SOLO EXERCISE APPARATUS

RELATED APPLICATION

This application claims the benefit of priority to U.S. provisional application Ser. No. 62/790,654 filed Jan. 10, 2019 and U.S. Ser. No. 62/830,640 filed Apr. 8, 2019, the disclosures of which are herein incorporated by reference.

FIELD OF THE INVENTION

The invention is directed to a portable modular exercise apparatus in kit form that can be disassembled for storage and that is configured for workouts by one or two users to execute a wide variety of bodyweight exercises including pull-ups, dips, crunches, leg raises and inclined push-ups.

BACKGROUND OF THE INVENTION

Some bodyweight exercises can be performed without equipment, including isometric exercises and pushups, while other exercises are enhanced or made possible by the use of exercise apparatus of the type that is commonly found in gyms or in parks. Home exercise apparatus is also popular, although space constraints often mandate that it be compact and movable for storage when not in use. Some bodyweight exercises requiring equipment, such as pull-ups, can be performed in a user's home through the installation of a pull-up bar in a doorframe. A need exists for a sturdy yet versatile apparatus in kit form that permits the user to undertake a broad range of bodyweight exercises, while at the same time being sufficiently compact, easy to set up and disassemble without specialized tools in a short period of time, movable across bare and carpeted floors even when assembled, and easy to disassemble and move for storage, e.g., vertically in a closet or horizontally under a bed.

SUMMARY OF THE INVENTION

The modular exercise apparatus kit of the present disclosure is an improvement over the apparatus which is described in U.S. Pat. No. 10,471,293 issued Nov. 12, 2019, the disclosure of which is incorporated in its entirety herein by reference. As in the patented configuration, the exercise apparatus that is described below is ideally configured for home use, and is also eminently suitable for use in gyms, physical therapy and rehabilitation facilities, and the like.

In an embodiment of the modular portable exercise apparatus of the present disclosure, a pair of rigid unitary tubular frames are each symmetrically constructed from a horizontal base member, two spaced-apart vertical members joined at their upper ends by a top member that is horizontal to the base member. Both of the vertical members and the top member are provided with a plurality of horizontally aligned apertures passing through the members with axes that are transverse to the longitudinal axis of the base member.

The frame members are joined in secure parallel alignment by rigid cross bars the opposing ends of which are internally threaded and that are positioned in alignment with the apertures in the opposing frames and secured in place by correspondingly threaded manually adjustable mounting bolts that pass through the apertures and into threaded engagement with the respective opposing ends of the cross bars.

In order to facilitate the positioning and alignment of the cross bars on the frames during installation, a rigid L-shaped mounting bracket is permanently secured to the opposing ends of the cross bar with the threaded opening centered in the secured transverse arm of the mounting bracket, with the free arm configured and dimensioned to engage the adjacent surface of the respective vertical or top member to which it is being joined to thereby center and align the axis of the cross bar and its internally threaded opening with the aperture through which the mounting bolts are passed. This arrangement facilitates the easy and secure assembly of the ends of the cross bar to the opposing frames, the assembly being drawn into a close-fitting relation by the manual rotation and tightening of the handles on the ends of the mounting bolts.

The assembly is further stabilized by a generally U-shaped rigid supporting member that is releasably secured to the upper surface of each base member by a manually adjustable mounting bolt that passes through an aperture and into a threaded opening in the base member below. The U-shaped supporting member has legs extending to the floor and terminating in outwardly extending horizontal flanges which contact the floor. Prior to assembly, the supporting members are secured in position on the respective base member, to stabilize the frames vertically during their assembly. During storage, the orientation of the supporting members is reversed and they are secured to the top of the base members.

An additional feature of the apparatus is a plurality of hanger bolts that are manually adjustable and preferably permanently installed on the underside of the top members to receive the transverse arm of the L-shaped mounting bracket by means of a slotted opening that is received on the shaft of the hanger bolt, after which the hanger bolt is manually turned until the underside of its handle firmly positions the mounting bracket arm against the underside of the top member. The number of hanger bolts corresponds to the number of cross bars, so that each cross bar can be securely stowed in position within the planes defined by the exterior surfaces of the vertical and top members for transportation and storage.

It will be understood that in the description that follows and in the attached drawings, the dimensions that are recited and the relative proportions of the various elements are not critical and can fall within a range. They are derived from a working prototype, and have been found to accommodate users of a wide range of heights in combination with the ability of the individual user to adjust the position of the several horizontal cross bars, as described. The frame members (20) are conveniently fabricated from 3"×1½" rectangular aluminum tube stock that is ⅛" thick and are joined, e.g., by welding or braising to form a robust unitary structure. The tubular members can be of other shapes, e.g., round and oval, and other materials, e.g., mild steel and alloys. The opposing frames are preferably of identical construction for economy of fabrication and ease of assembly. In a preferred embodiment, when assembled for use it is approximately 66" long, 49" high and 28" wide When the apparatus is disassembled to its principal component elements and prepared for storage, it is approximately 66" long, 49" high and 6" wide.

The modular configuration of the apparatus permits the kit to be shipped in corrugated cardboard packing materials that can be manually transported during handling and delivery.

BRIEF DESCRIPTION OF THE DRAWINGS

Preferred embodiments of the invention are described in more detail below and with reference to the attached drawings in which.

DETAILED DESCRIPTION OF THE INVENTION

Figure 1:
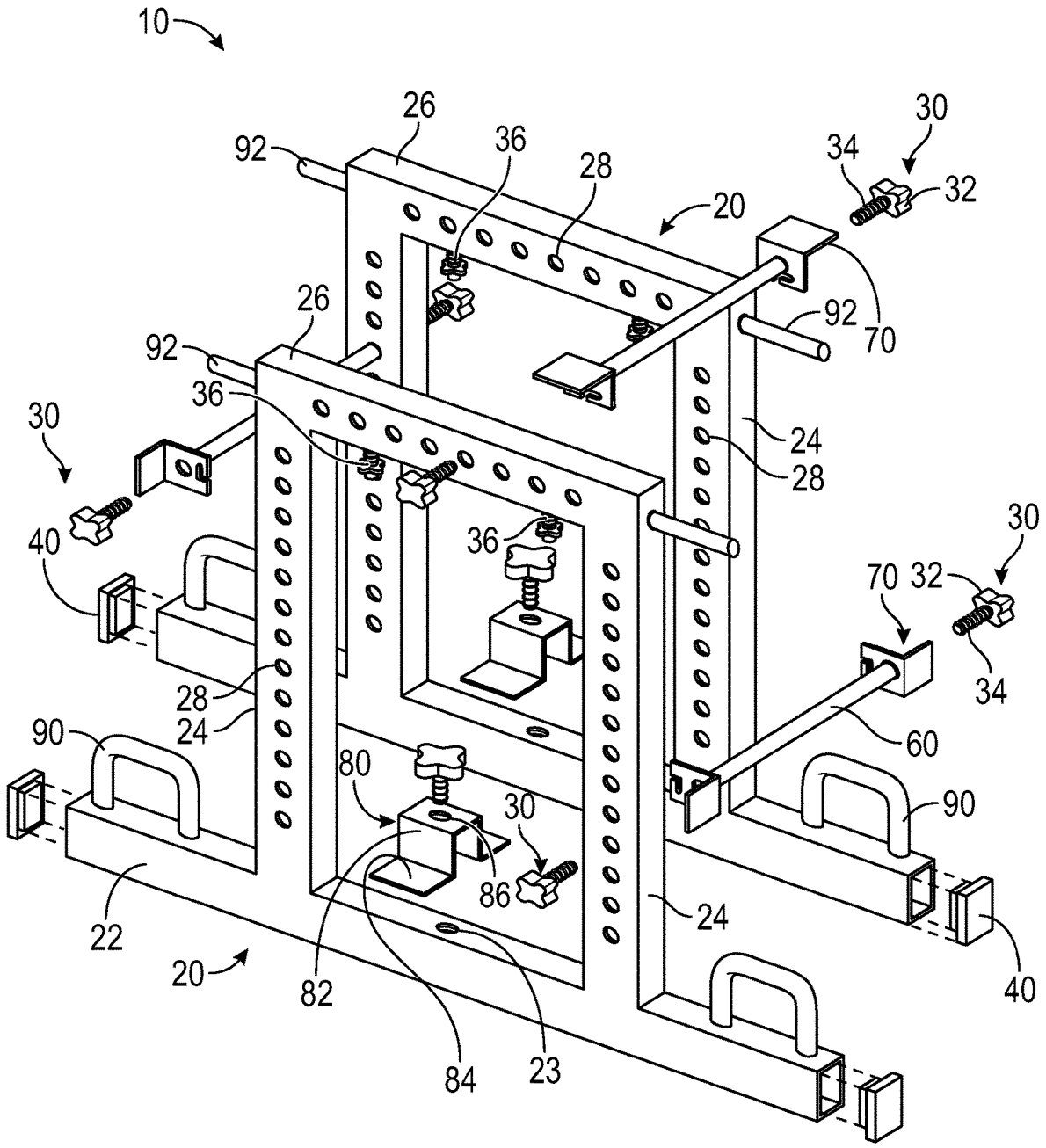
FIG. 1 is an exploded perspective view of the components of the exercise apparatus configured for simultaneous use by two individuals.
Figure 2:
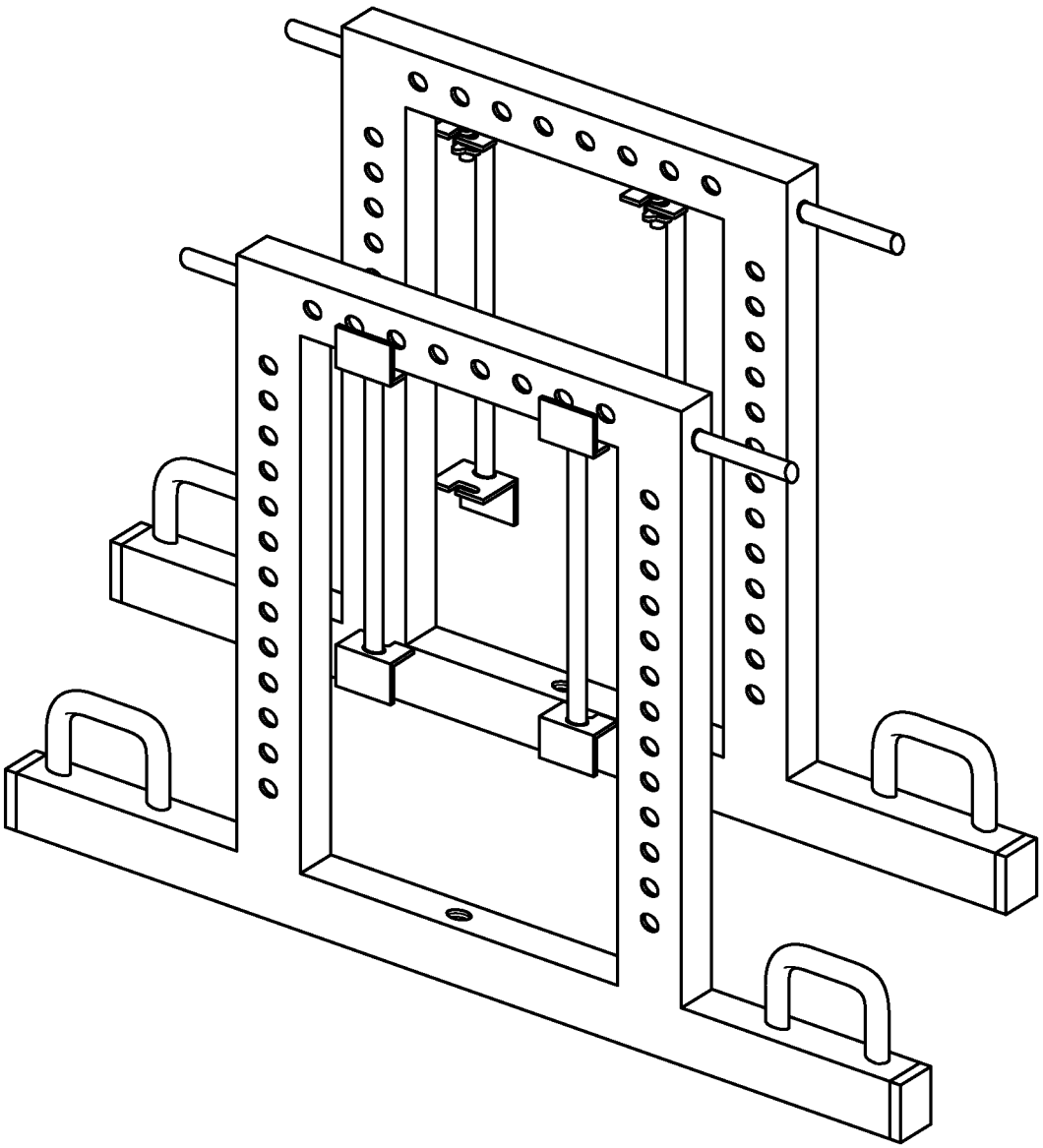
FIG. 2 is a perspective view of the exercise apparatus in preparation for storage.
Figure 3:
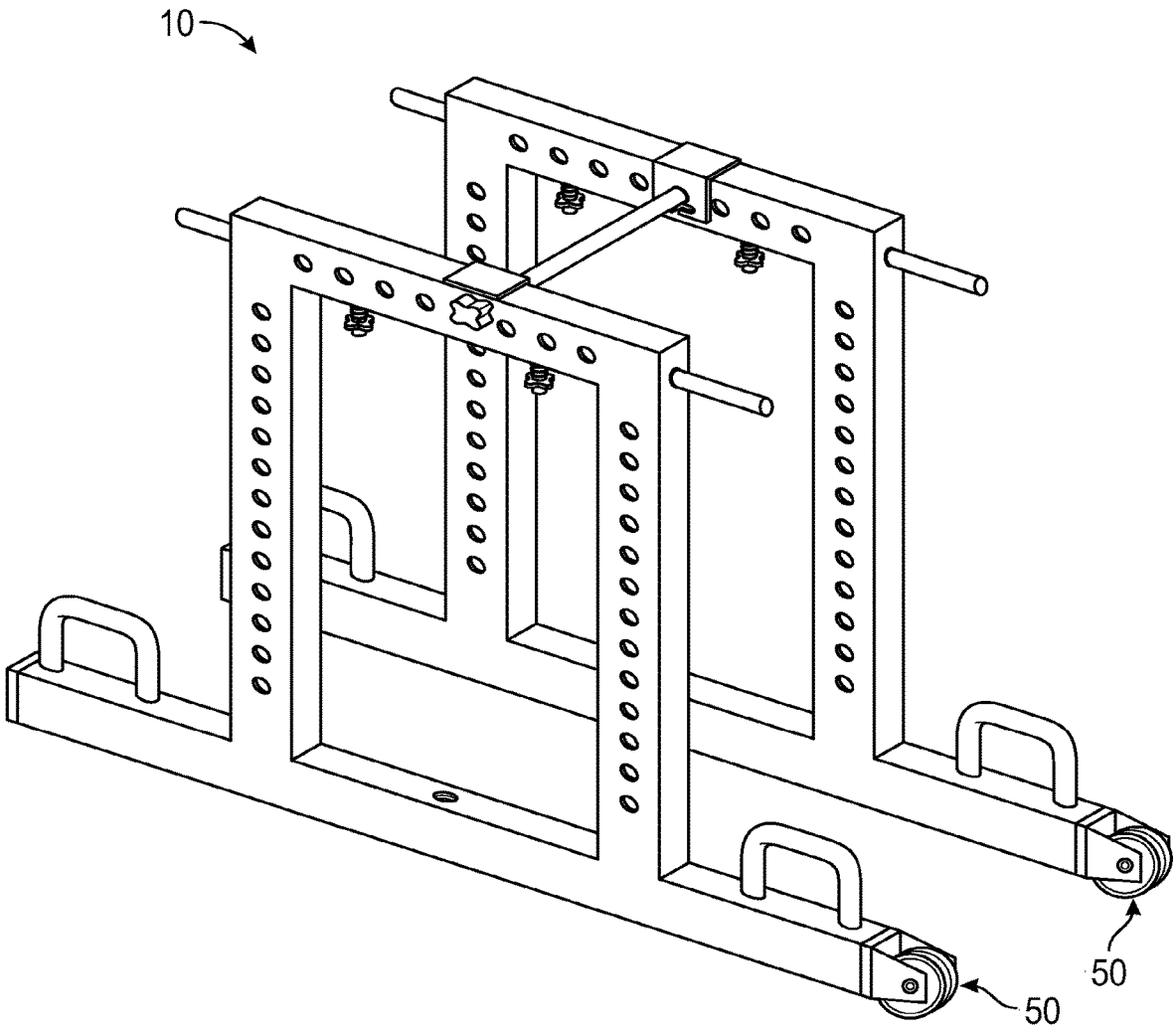
FIG. 3 is a view of the exercise apparatus with the top crossbar installed.

Referring now to FIGS. 1-3, as illustrated the exercise apparatus 10 is constructed from a plurality of rectilinear rigid metal tubes to provide flat stable supporting surfaces for contacting the floor. The apparatus comprises a pair of integral rigid frame members (20) constructed from four sections of metal tube that are joined by welding or other methods known in the art. Welding is especially suitable for providing smooth joints and seams, and for convenience will be the only method referred to below. Aluminum is a preferred material of construction due to its strength and relatively lighter weight compared to other metals.

Each of frame members (20) is comprised of a longitudinal base member (22), a pair of spaced-apart vertical members (24) joined to, and extending upwardly to support a longitudinal top member (26) that is parallel to the base member (22). In constructing the frame member (20), the vertical members (24) and the top member (20 are advantageously first welded to form a U-shaped structure, the open end of which is then welded to the base member (22).

In order to provide and assure the stability and safety of the apparatus during a vigorous workout by users, each base member (22) is provided with at least one generally centrally located U-shaped supporting member (80) that is secured in place on base member (22) by a threaded mounting bolt (30) received in an internally threaded opening (23). As shown in FIG. 1, each threaded opening is configured to receive a mating machine threaded bolt (30) for securing in place a separate supporting member (80). In the embodiment illustrated in FIG. 1, the supporting member (80) is U-shaped and conforms closely to the top and side contours of the tube stock of base member (22), with legs (82) that terminate in flanges (84) that provide a broad auxiliary stabilizing support for the frame (20) on a horizontal supporting floor surface.

As illustrated, threaded bolts (30), as well as all other threaded bolts referred to below and shown in the drawings, are provided with an integral handle to facilitate the manual positioning and tightening of the bolt in threaded openings provided in various components of the apparatus. For convenience, the machine threaded bolts are of uniform length and are interchangeable. The bolt handles can be of any conventional configuration that provides a secure comfortable grip and adequate leverage to manually tighten the bolt once positioned to secure the cross bars (60) and supporting members (80) in place. As explained above, the apertures (28) in the vertical and top members are dimensioned to permit the free passage of the threaded shaft (34) of mounting bolt (30). The ends of the threaded shaft (34) preferably chamfered to facilitate their passage through the apertures (28) and proper alignment with the receiving threads in the ends of cross bars (60).

In an embodiment, the cross bar (60) comprises a length of rigid pipe, tubing or a solid rod that is comfortable to grip during use, e.g., with an outside diameter in the range of from 1.25" to 1.5", and that is approximately 27" to 30" long. The ends of the cross bar are internally threaded to receive the threaded mounting bolt (30). In an embodiment, an internally threaded stationary bushing (not shown) is secured in a corresponding opening in the end of the cross bar.

Figure 4:
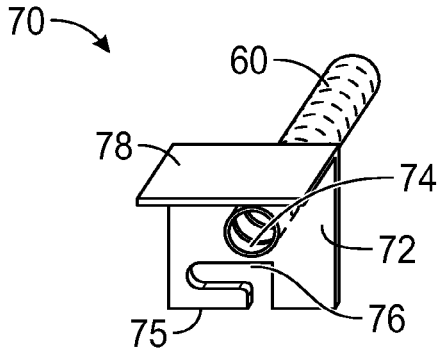
FIG. 4 is a detail of the cross bar mounting brackets.

An L-shaped end bracket (70) is provided with a central opening (74) in a transverse arm (72) to receive the end of the cross bar, to which the bracket is welded at a right angle and finished to provide a relatively smooth flat surface. The dimensions of arms (72,78) of the bracket correspond to the contour and dimensions of the adjacent sides of the top member (2.6) and vertical members (24) to which they are attached, as is explained below, to securely join the assembled frames (20). As illustrated, the arms (72, 78) are planar and correspond in size to the height and width of the rectangular tubular members (24, 26). As can best be seen in FIG. 4, end bracket (70) includes central opening (74) that corresponds to the exterior diameter of the pipe (60). Mounting bracket (70) also includes an L-shaped slot opening (76) with one leg that extends from the outer edge (75) toward the center opening (74), the other leg being parallel to the edge. The L-shaped slot opening is dimensioned to pass the shaft of a hanger bolt by which the cross bar assembly is suspended when not in use as explained below.

The vertical members (24) and top member (26) are provided with a plurality of unthreaded apertures (28) as illustrated. The diameter of the apertures is predetermined to freely pass the shaft of the threaded mounting bolts (30). To assemble the exercise apparatus (10), a flanged U-shaped supporting member (80) is secured to each base member (22) and the pair of frames (20) are positioned parallel with their ends aligned and spaced apart to receive a cross bar.

A cross bar (60) is positioned between the top members (26), with the free arm (78) of an end bracket (70) resting on the upper surface of the top member (26); threaded mounting bolts (30) are then passed through the apertures (28) in the opposing top members (26) and into the internally threaded ends of the cross bar (60); the mounting bolts (30) are manually tightened to bring the arm (72) of the mounting bracket (70) into contact with the side wall of top member (26), thus securing the cross bar (60) and the frames (20) together to form a rigid unified structure. As will be apparent, the cross bar (60) when installed as described can be utilized as a pull-up bar.

Additional cross bars (60) with integral end brackets (70) can similarly be mounted by means of apertures (28) and threaded bolts (30) between the vertical members (24) and at additional locations along the top member (26) to accommodate a variety of exercise routines. Due to its symmetrical construction of this embodiment, all the exercises that can be performed on one end of the apparatus by one user can also be performed at the same time on the opposite side by a second user.

The undersides of top members (26) are provided with threaded openings (not shown) to receive hanger bolts (36) that serve to support cross bars (60) in a vertical storage position when they are not in use, or when the exercise apparatus is disassembled. The shafts of cross bar hanger bolts are dimensioned to receive the L-shaped slot opening (76) in the transverse arm (74) of end bracket (70).

With continuing reference to FIGS. 1-3, inverted U-shaped handles (90) serve the dual purpose of elevated push-up grips and also as hand grips for lifting to relocate or reposition one or both ends of the frames (20) in either the assembled or disassembled configuration. The U-shaped hand grips or handles (90) are positioned proximate the opposing ends on the upper surface of the base member (22), and can be fabricated from appropriately configured pipe or other tubular sections, or rods to a length of about 9" and a height of 4" to 5", and secured by welding.

Dip bars (92) are permanently secured, e.g., by welding, as a longitudinal extension about 8" to 9" long at each end of the top member (26). The dip bars can be fabricated from sections of 1" pipe, i.e., with an outside diameter of approximately 1.25". It will be understood that all of the hand-gripping surfaces can be provided with knurling, or other conventional surface treatments.

Figure 5:
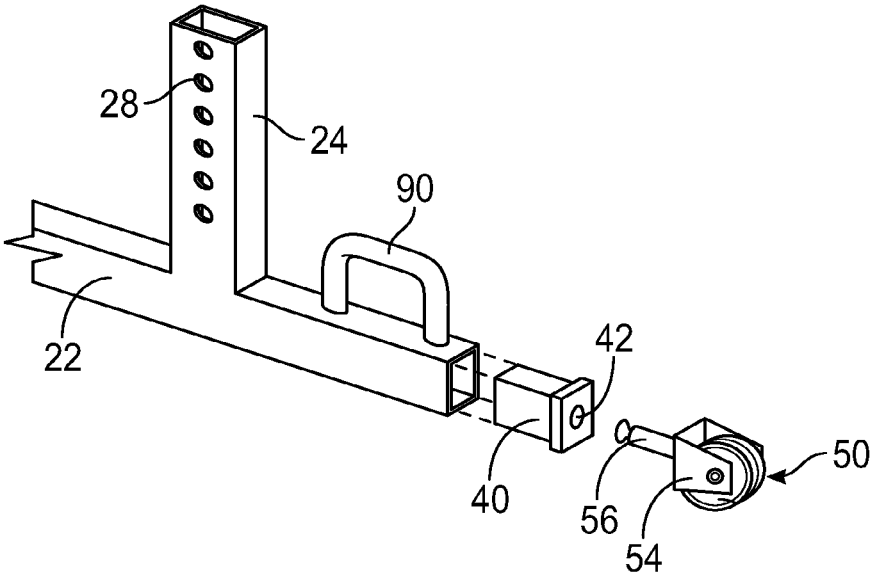
FIG. 5 is an enlarged exploded view of an alternate embodiment of an end cap wheel assembly.

Moving of the apparatus is facilitated by the installation of wheel assemblies (50), such as that shown in FIG. 5, that are dimensioned and configured to be securely inserted into the open ends of the tubular base member (22). The wheel (52) can be permanently joined to the standard end cap (40), e.g., by a threaded shaft and a mating nut (not shown) that permits the wheel to contact the supporting surface when the opposite end of the apparatus is lifted vertically. Alternately, the end cap (40) can be provided with a central opening (42) that releasably receives in a snap-fit engagement a contoured shaft (56) joined to a wheel housing (54) extending from the wheel assembly (50). This arrangement is commonly found on furniture caster wheels and permits the wheel assembly to be removed when the assembled apparatus is in use to eliminate a potential trip hazard to users. The wheel assembly can be reinserted in the hole in the end cap when the assembled apparatus, or the individual frames are to be moved, e.g., for storage. It will be understood that the end caps are dimensioned and configured to be received in a secure friction fit in the open end of the tubular base members (22).

From the above description, it will be understood that the modular portable exercise apparatus (10) of the present disclosure broadly comprehends:

a. a pair of rigid unitary frames (20), each frame comprising:

i. an elongated base member (22) dimensioned and configured to support the frame on a horizontal surface;

ii. a pair of spaced-apart generally parallel vertical members (24) extending from and permanently joined to an upper surface of the base member;

iii. a top member (26) extending between and permanently joined to the upper ends of the vertical members (24), the top member being parallel to the base member (22);

b. at least one generally U-shaped rigid supporting member (80) configured and dimensioned to be releasably secured to the upper surface of the base member (22) and having depending legs (82) extending to a horizontal plane that is tangential to the exterior bottom surface of the base member (22), where preferably both of the legs terminate in outwardly extending flanges (84) configured to contact the horizontal surface supporting the base member;

c. a plurality of rigid tubular cross bars (60), each having rigid L-shaped mounting brackets (70) permanently secured to the opposite ends of the bar, one arm (72) of each of the mounting brackets provided with a central opening (74) for receiving an internally threaded end (62) of the tubular cross bar (60) in a close-fitting flush-mounted relationship and secured at a right angle to the cross bar, the central opening (74) being dimensioned and configured to align the tubular opening in the cross bar (60) with a pair of horizontally aligned mounting apertures (28) provided in the vertical members (24) and top member (26) of the frame (20) that are configured to pass in close-fitting relation to a matingly threaded manually adjustable mounting bolt (30) through the frame member and into the internally threaded opening (62) in the tubular cross bar (60) and to thereby directly support the cross bar, the adjacent arm (76) of the L-shaped bracket (70) being dimensioned and configured to contact a surface of the frame member adjacent the mounting apertures (28), whereby the bracket-mounted cross bar (60) secured at its opposing ends to the respective frame members by the threaded mounting bolts (30) maintains the frames (20) in secure parallel alignment.

Figure 6:
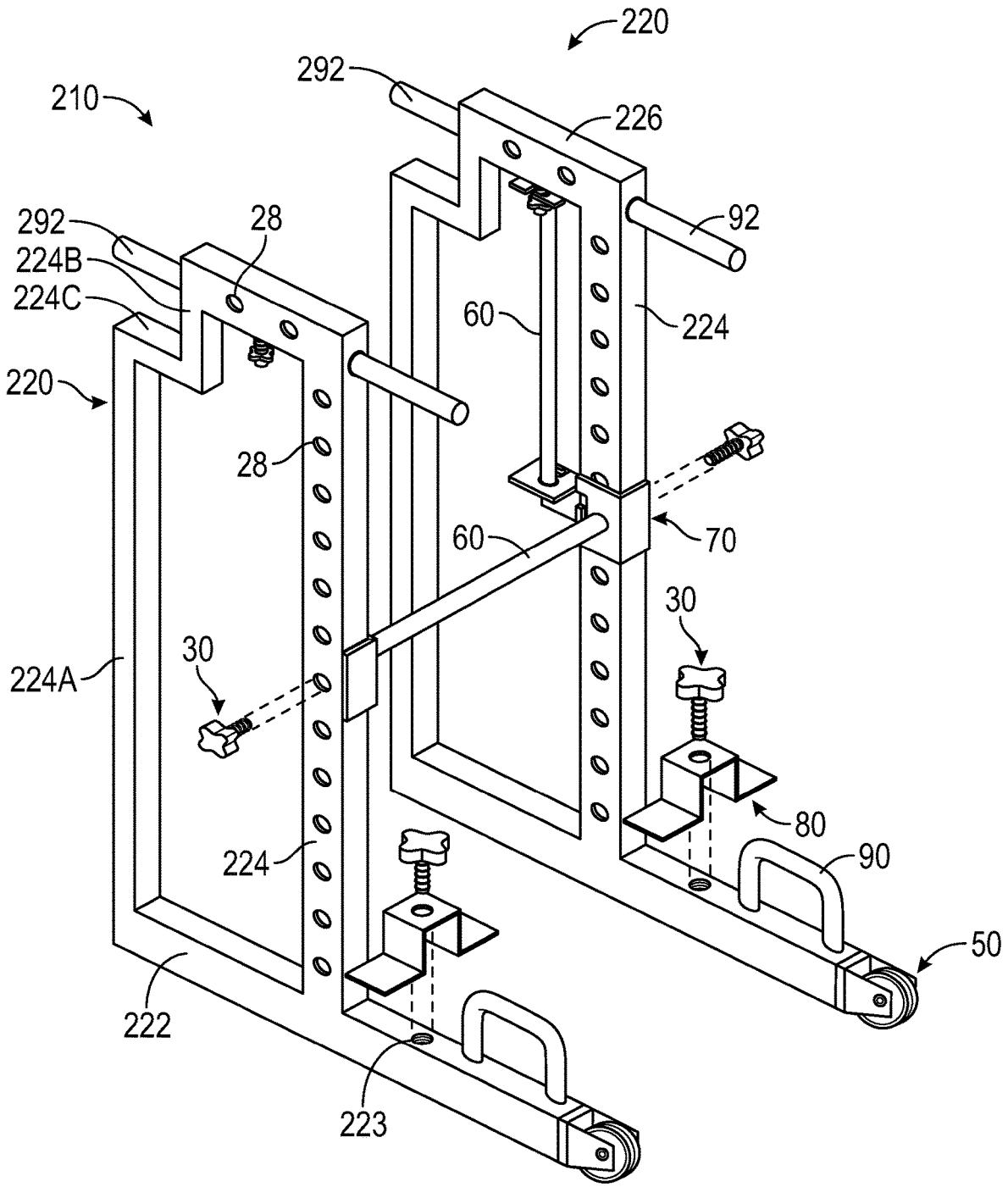
FIG. 6 is an exploded view of the components of an alternate embodiment of the invention that is configured for solo use by an individual.
Figure 7:
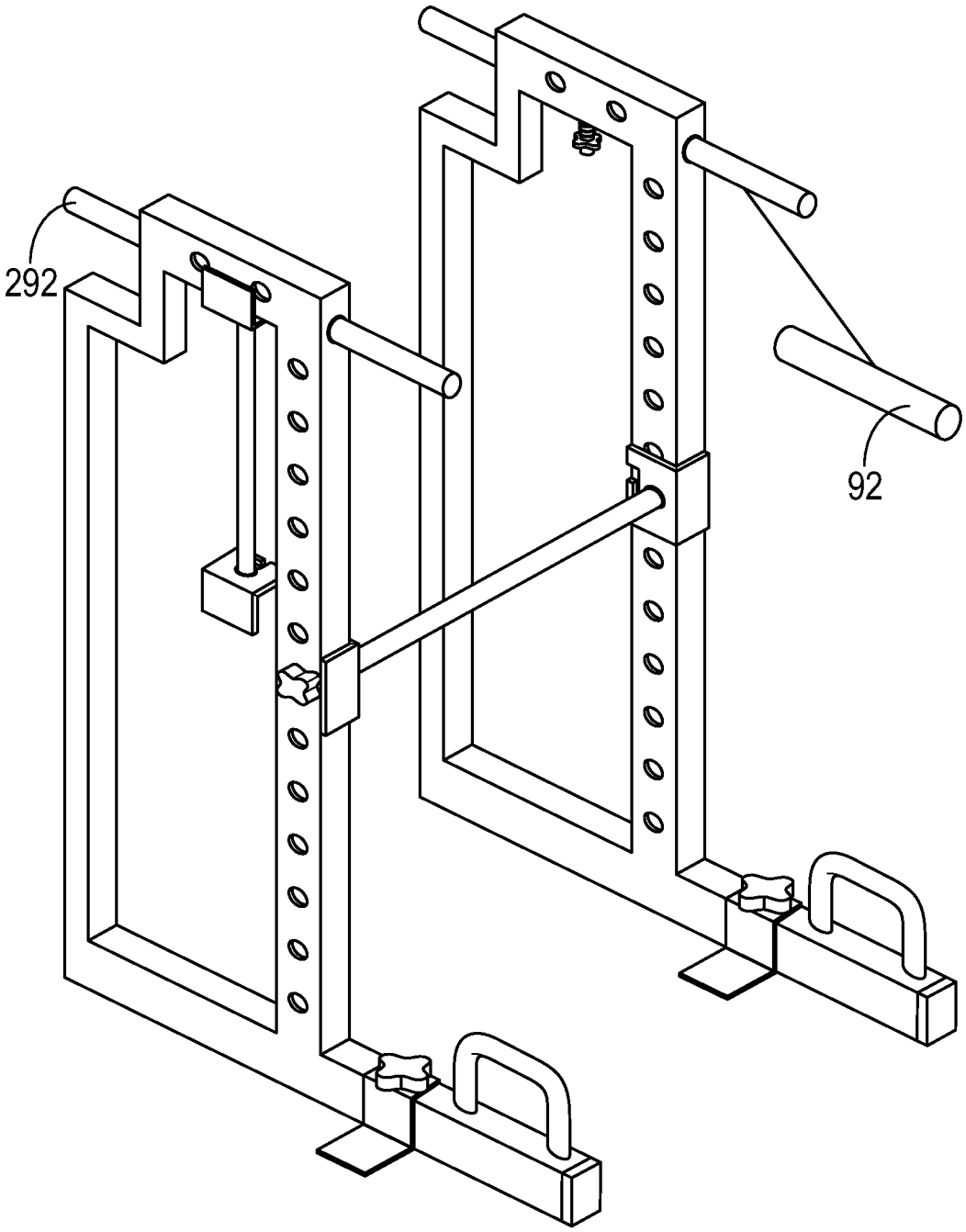
FIG. 7 illustrates the assembly of the exercise apparatus of FIG. 6 with a cross bar installed.

Referring now to FIGS. 6 and 7, a more compact embodiment of the apparatus (210) that is configured for solo use will be described. As will be apparent from a comparison with the apparatus shown in FIGS. 1-3, the length of the frames (220) of FIGS. 6 and 7 are reduced, and the vertical member (224A) includes an offset horizontal section (224C) positioned between its upper section (224B) and below its intersection with top member (226).

The step or offset section (224C) between the two vertical sections (222A, 222B) of the frame members (220) permits the user to easily lift the end of the assembled frames by, elongated upper handles (292) in the form of a rod or pipe when the apparatus is to be moved to a new location for use, or to a location for storage of the disassembled unit. The projecting ends of handles (292) are positioned between the projection of the outer surface of vertical members (224A, 224B) in order to avoid damaging a wall surface adjacent that end of the apparatus during use or during storage of the individual frame members, e.g., in a closet or beneath a bed. The carrying/moving handles (292) as positioned in the offset region also provide sufficient space for the user to comfortably grip the handle(s) when lifting the apparatus. As in the dual embodiment described above, the frames (220) unit can be fitted with wheel assemblies (50) to assist in moving the exercise apparatus (210).

The other elements of this "solo" user embodiment of FIGS. 6 and 7 are substantially identical in form and function to those shown and described in connection with the embodiment of FIGS. 1-3, above, and the same element numbers are used for convenient reference in both embodiments. Dimensions of the assembled frames (210) of the embodiment shown in FIG. 7 are as follows: base 27", overall height 49" and outside width 29". The apertures provided in vertical member (224) and top member (226) are dimensioned as described above to pass the shafts of threaded mounting bolts (30) that secure the cross bars and end brackets in place. The mounting of supporting members (80) can be positioned proximate to, and on either or both sides of the vertical member (224) towards the center of the base member (222).

As will be apparent from the above description, the apparatus of the present invention can be quickly and easily assembled without special tools or hardware following its initial purchase or after removal from storage. Once assembled, the apparatus can be utilized in a self-evident and effortless manner to perform total body exercises at virtually any location, and in a manner that is not only easy and effective, but that is intuitive and can be performed with a minimal amount of training and/or experience with the apparatus.

The foregoing written description and the drawings have been provided to facilitate and enhance the full understanding of the invention. While preferred embodiments of the present invention have been illustrated and described, it will be apparent that such embodiments are provided by way of example and that other variations, changes and modifications will be apparent to those skilled in the art, and that the scope of the invention is to be determined by the claims that follow.

The invention claimed is:

1. A modular portable exercise apparatus comprising:

a. a pair of rigid unitary frames, each rigid unitary frame comprising:

i. an elongated base member dimensioned and configured to support the respective rigid unitary frame on a horizontal surface;

ii. a pair of spaced-apart parallel vertical members extending from and permanently joined to an upper surface of the elongated base member;

iii. a top member extending between and permanently joined to the upper ends of the pair of spaced-apart parallel vertical members and parallel to the elongated base member;

b. at least one U-shaped rigid supporting member configured and dimensioned to be removably secured to the respective upper surface of each elongated base member and having depending legs extending to a horizontal plane that is tangential to an exterior bottom surface of the respective elongated base member, where at least one of the depending legs terminates in a flange extending horizontally outward from the respective elongated base member to contact the horizontal surface supporting the respective elongated base member;

c. a plurality of rigid tubular cross bars with internally threaded tubular openings, each having rigid L-shaped mounting brackets permanently secured to opposite ends of the respective rigid tubular cross bar, a first arm of each of the rigid L-shaped mounting brackets provided with a central opening for receiving the internally threaded tubular opening of the respective rigid tubular cross bar in a close-fitting flush-mounted relationship and secured at a right angle to the respective rigid tubular cross bar, the central opening dimensioned and configured to align the internally threaded tubular opening in the respective rigid tubular cross bar with a pair of horizontally aligned mounting apertures provided in each of the pair of spaced-apart parallel vertical members and top member of each of the pair of rigid unitary frames that are configured to pass a threaded manually adjustable mounting bolt in close-fitting relation through the respective mounting apertures and into the internally threaded tubular opening in the respective rigid tubular cross bar and to thereby directly support the respective rigid tubular cross bar, a second adjacent arm of each of the rigid L-shaped mounting brackets being dimensioned and configured to contact a surface of the respective vertical member or top member adjacent the respective mounting apertures, whereby the respective rigid tubular cross bar secured at its opposing ends to the respective vertical or top members by the threaded manually adjustable mounting bolts maintains the pair of rigid unitary frames in secure parallel alignment.

2. The modular portable exercise apparatus of claim 1 in which a first vertical member of each of the pairs of spaced-apart parallel vertical members is straight and a second vertical member of each of the pairs of spaced apart parallel vertical members is configured with a lower vertical section and an upper vertical section connected by an offset section extending parallel to the respective elongated base member to thereby displace the upper vertical section of the second vertical member in the direction of the first vertical member.

3. The modular portable exercise apparatus of claim 2 in which a length of each offset section ranges from 8 inches to 10 inches and is displaced vertically from the top member of the respective rigid unitary frame a distance ranging from 5 inches to 7 inches.

4. The modular portable exercise apparatus of claim 3 which further comprises an elongated horizontal handle that is secured to the upper vertical section of each of the second vertical members, to thereby facilitate manual gripping of the elongated horizontal handle by a user.

5. The modular portable exercise apparatus of claim 1 in which the depending legs of each of the at least one U-shaped rigid supporting members are configured and dimensioned to closely fit top and side walls of the respective elongated base member and each of the depending legs terminates in an outwardly extending horizontal flange.

6. The modular portable exercise apparatus of claim 5 in which each of the at least one U-shaped rigid supporting members is removably secured to the respective elongated base member between the respective pair of spaced-apart parallel vertical members.

7. The modular portable exercise apparatus of claim 5 in which a width of each of the at least one U-shaped rigid supporting members measured along the longitudinal axis of the respective elongated base member on which it is positioned is in the range of from 4 inches to 6 inches, and the horizontal flanges respectively extend from each depending leg a distance ranging from 3 inches to 5 inches.

8. The modular portable exercise apparatus of claim 1 in which each of the threaded manually adjustable mounting bolts comprises an elongated machine threaded shaft terminating in a tapered guide surface, an opposing end of the elongated machine threaded shaft being permanently secured to a handle that is dimensioned and configured to facilitate manual adjustment of the respective threaded manually adjustable mounting bolt to secure components of the modular portable exercise apparatus to the pair of rigid unitary frames.

9. The modular portable exercise apparatus of claim 8 in which a portion of the handle proximate the elongated machine threaded shaft for each of the threaded manually adjustable mounting bolts has a broad planar surface that functions as an integral washer.

10. The modular portable exercise apparatus of claim 1 in which the first arm of each rigid L-shaped mounting bracket includes an L-shaped slot opening with a first leg of the L-shaped slot opening extending from an outer edge of the first arm toward the respective rigid tubular cross bar and a second leg of the L-shaped slot opening extending parallel to the outer edge, the L-shaped slot opening dimensioned to receive in close-fitting sliding relation a vertical shaft of a manually adjustable threaded hanger bolt.

11. The modular portable exercise apparatus of claim 10 which further comprises a plurality of manually adjustable threaded hanger bolts that are vertically positioned in threaded openings in an underside of the top member proximate its intersection with the pair of spaced-apart parallel vertical members of each of the pair of rigid unitary frames to engage the L-shaped slot opening formed in the first arm of each respective rigid L-shaped mounting bracket extending from each respective rigid tubular cross bar, each of the plurality of manually adjustable threaded hanger bolts having a handle permanently attached to a threaded shaft and having a planar surface dimensioned to contact the first arm of each respective rigid L-shaped mounting bracket and secure the respective rigid tubular cross bar for storage in a vertical orientation against the underside of the top member of a respective one of the pair of rigid unitary frames.

12. The modular portable exercise apparatus of claim 1 in which an upper surface of each of the at least one U-shaped rigid supporting members is provided with a central aperture that is dimensioned to pass a threaded shaft of a mounting bolt in close-fitting relation.

13. The modular portable exercise apparatus of claim 1 in which the pair of rigid unitary frames are fabricated from rectangular aluminum tube stock.

14. The modular portable exercise apparatus of claim 1 in which the internally threaded tubular openings of each of the plurality of rigid tubular cross bars are fitted with internally threaded stationary bushings.

15. The modular portable exercise apparatus of claim 1, wherein at least one of the plurality of rigid tubular cross bars is attached between the top members of the pair of rigid unitary frames and at least one of the plurality of rigid tubular cross bars is attached between respective ones of the pairs of spaced-apart parallel vertical members of the pair of rigid unitary frames.

* * * * *